US007104544B2

(12) United States Patent
Reiner et al.

(10) Patent No.: US 7,104,544 B2
(45) Date of Patent: Sep. 12, 2006

(54) CASINO STYLE WAGERING GAME

(76) Inventors: Daniel E. Reiner, 1480 W. Donner, Pahrump, NV (US) 89048; Charles Muench, 1891 Lemon Grove St., Henderson, NV (US) 89052

( * ) Notice: Subject to any disclaimer, the term of this patent is extended or adjusted under 35 U.S.C. 154(b) by 25 days.

(21) Appl. No.: 10/835,339

(22) Filed: Apr. 29, 2004

(65) Prior Publication Data

US 2005/0242505 A1 Nov. 3, 2005

(51) Int. Cl.
*A63F 1/00* (2006.01)

(52) U.S. Cl. ..... 273/292; 273/138 R; 273/139

(58) Field of Classification Search ..... 273/292
See application file for complete search history.

(56) References Cited

U.S. PATENT DOCUMENTS 4,560,161 A * 12/1985 Hamano ..... 463/13
4,560,171 A * 12/1985 Anthony ..... 273/269
5,029,871 A * 7/1991 Willson, Jr. et al. ..... 273/271
5,092,598 A * 3/1992 Kamille ..... 273/139
5,100,139 A * 3/1992 Di Bella ..... 273/292
5,377,992 A * 1/1995 Audet ..... 273/271
5,823,873 A * 10/1998 Moody ..... 463/13
6,033,306 A * 3/2000 De Souza ..... 463/18
6,149,157 A * 11/2000 Suan ..... 273/292
6,227,969 B1 * 5/2001 Yoseloff ..... 463/13
6,457,714 B1 * 10/2002 Feola ..... 273/274
6,698,759 B1 * 3/2004 Webb et al. ..... 273/292
6,913,531 B1 * 7/2005 Yoseloff ..... 463/13

* cited by examiner

*Primary Examiner*—Eugene Kim
*Assistant Examiner*—Dolores Collins
(74) *Attorney, Agent, or Firm*—Rob L. Phillips; Greenberg Traurig

(57) ABSTRACT

A wagering game combining the attributes of keno and video poker is disclosed. First, players place wagers and select one or more cards from a plurality of face-up cards. One or more cards from the plurality of cards are then randomly identified. Players receive awards based on the number of randomly identified cards which match player selected cards and/or the strength of a poker hand formed by the randomly identified cards. Players may also be provided an option to replace one or more of the randomly identified cards with new randomly identified cards. An optional bonus award is directed to the position of the randomly identified cards. For example, if two or more of the randomly identified cards are arranged adjacent to one another or in a pre-determined card display pattern, a bonus ward is paid. The game may also be played in a live table game version or stand alone version similar to conventional keno.

18 Claims, 7 Drawing Sheets

CASINO STYLE WAGERING GAME

FIELD OF THE INVENTION

The embodiments of the present invention relate to a casino wagering game. More particularly, the embodiments relate to a wagering game combining aspects of keno and poker.

BACKGROUND

As the popularity of legalized gaming continues to increase, the desire for new games of chance increases as well. Therefore, significant numbers of new wagering games are being developed and promoted. However, a large number of the new wagering games are destined to fail. Reasons for failure include complexity, unfamiliar rules and a large house edge associated with the games. Thus, new games of chance which incorporate common themes and provide an acceptable house edge stand a better chance of success.

Accordingly, the embodiments of the present invention combine the games of poker and keno. In fact, poker is the most popular wagering card game in the world. Poker comprises the use of playing cards to form the highest poker hand pursuant to pre-established poker hand rankings. On the other hand, keno is a very popular casino numbers game wherein players select one to fifteen numbers from a pool of eighty numbers. Thereafter, twenty of the numbers from the pool of eighty numbers are randomly selected. Players are paid based on the number of matches between their selected numbers and the randomly selected twenty numbers.

Although poker and keno are popular in their own right, each game has been around for a long time and could use an infusion of excitement. Therefore, the embodiments of the present invention combine aspects of both games into a single exciting wagering game.

SUMMARY

Accordingly, a first embodiment of the present invention comprises an electronic gaming device (e.g., video poker machine or keno machine) displaying fifty-two playing cards from a standard deck of playing cards. Optionally, the deck may incorporate jokers which may act as wild cards. The playing cards are displayed face up. An infinite number of card arrangements are possible but the final arrangement is not critical to practicing the embodiments of the present invention. Once the cards are displayed, a player is able to select one or more of the cards. Then, one or more cards are randomly selected or identified by the gaming device. The player is first paid for the number of matches between the player selected cards and the randomly selected cards. Second, the player is provided a payout for pre-established poker hands formed by the randomly selected cards. Thus, the first embodiment provides multiple ways to win. In alternative embodiments, the player may be paid either for the number of matches or the formation of pre-established poker hands rather than both.

In another embodiment, players place a side wager based on predicting the upcoming specific poker hand, if any, which will be formed by the randomly selected cards. In yet another embodiment, the player is able to replace one or more randomly selected cards with new randomly selected cards.

While the embodiments of the present invention are ideal for electronic gaming devices, the embodiments may also be practiced in a live setting akin to live keno or may be practiced using a more restricted live gaming table.

These together with other objects and advantages which will become subsequently apparent from the details of the construction and operation as more fully hereinafter described and claimed.

DETAILED DESCRIPTION

The operation of electronic gaming machines, including video poker and keno machines, is well known in the industry so that the minute details are not set forth herein. In general terms, video poker and keno machines are controlled by processors including, or in communication with, a random number generator. The random number generator generates the machine's outcomes. A display in communication with the processor provides visual information to players.

Figure 1:
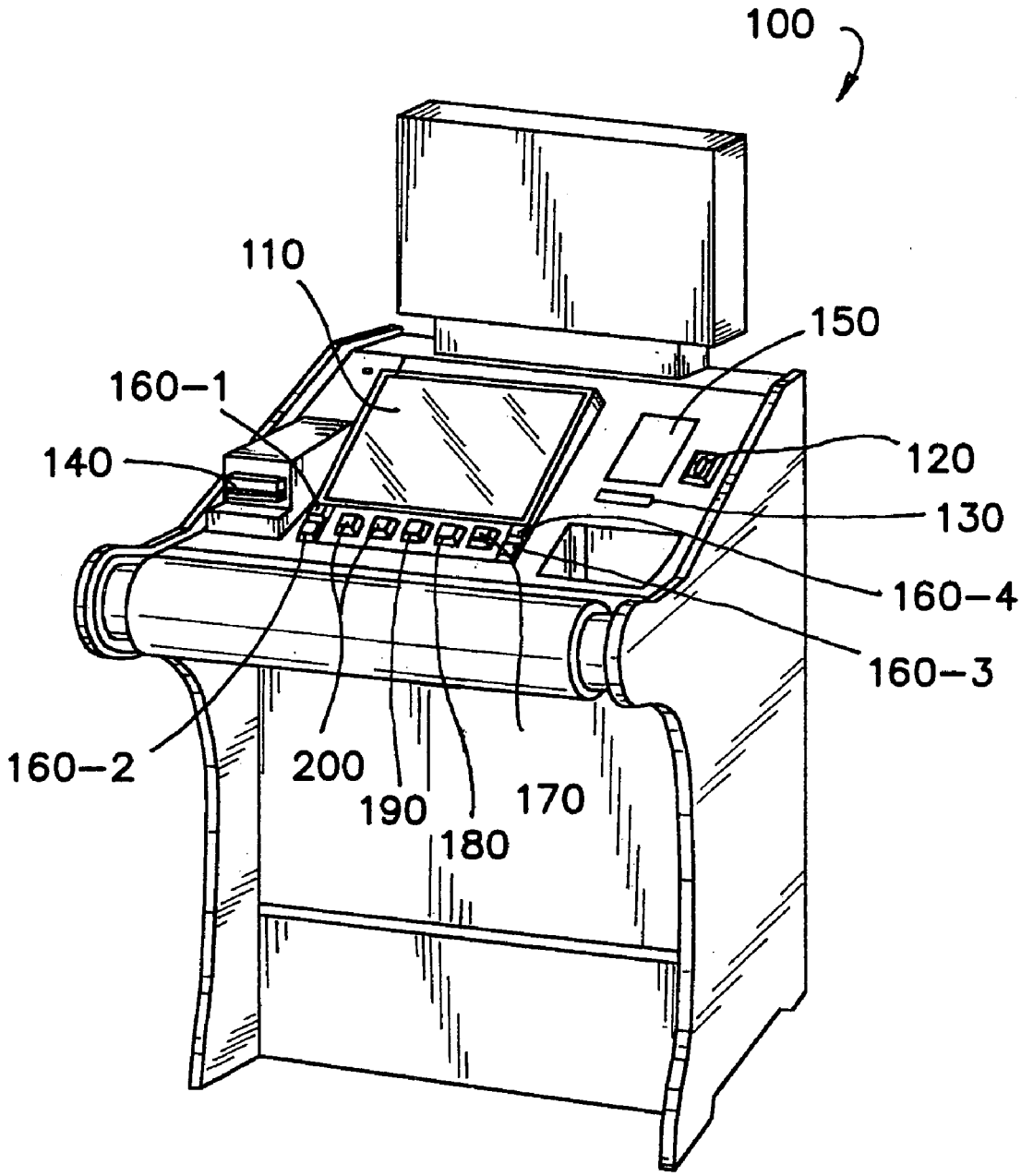
FIG. 1 shows a gaming device of the type for facilitating an electronic embodiment of the game.

Reference is now made to the figures wherein like parts are referred to by like numerals throughout. FIG. 1 illustrates a perspective view of a video poker or keno type gaming machine for facilitating the embodiments of the present invention and is generally denoted by reference numeral 100. The general external features of the video poker machine 100 include a display 110, coin slot 120, a bill reader 130, a card reader 140 and a credit display 150. The gaming machine 100 also includes several player buttons which act as interfaces between the player and the machine processor. Player buttons include directional buttons 160-1 through 160-4, a card selection button 170, a one coin wager button 180, a maximum coin wager button 190 and a start button 200. The directional buttons 160-1 through 160-4 comprise an up, down, right and left directional button for highlighting player cards which are then selected by depressing the card selection button 170. While not shown, the machine 100 may also incorporate a ticket dispenser for printing tickets for redemption at a cashier window. Such cashless systems are becoming increasingly popular in most gaming jurisdictions. It is noted that any of the functions facilitated by the gaming machine buttons 160–200 can be accomplished using a display employing touchscreen technology.

Figure 2:
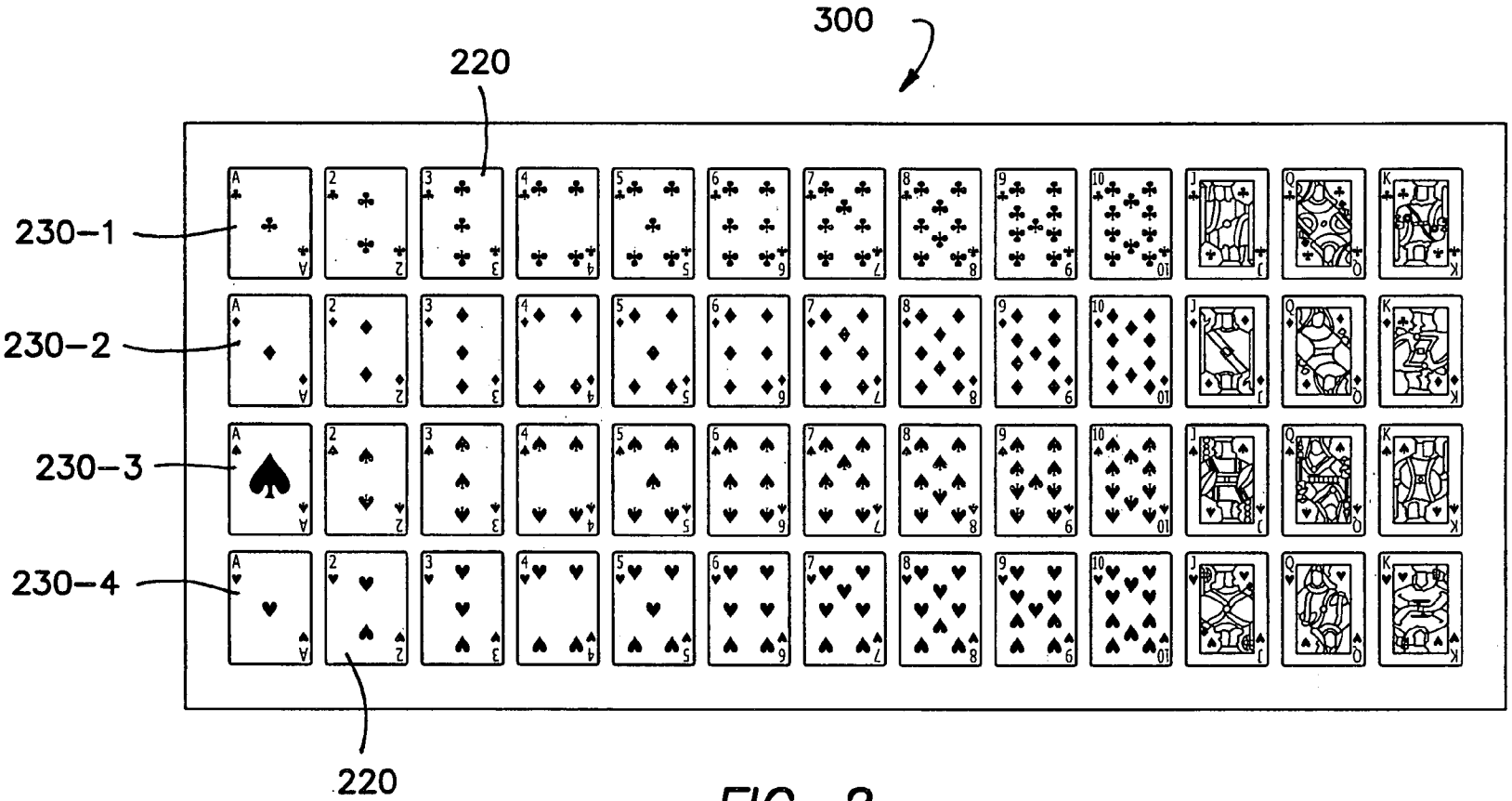
FIG. 2 shows a gaming device display screen displaying fifty-two playing cards.

In a first embodiment, as shown in FIG. 2, a display screen 300 displays fifty-two cards 220 from a standard deck of playing cards. As shown, the fifty-two cards 220 are arranged in four rows 230-1 through 230-4 wherein each row 230-1 through 230-4 represents one of the four card suits (i.e., spades, hearts, clubs and diamonds). Countless other card arrangements, such as four columns wherein each column represents a suit or random arrangements are possible. Optionally, jokers may be added to the deck to create additional game variations, including wild card games.

Figure 3:
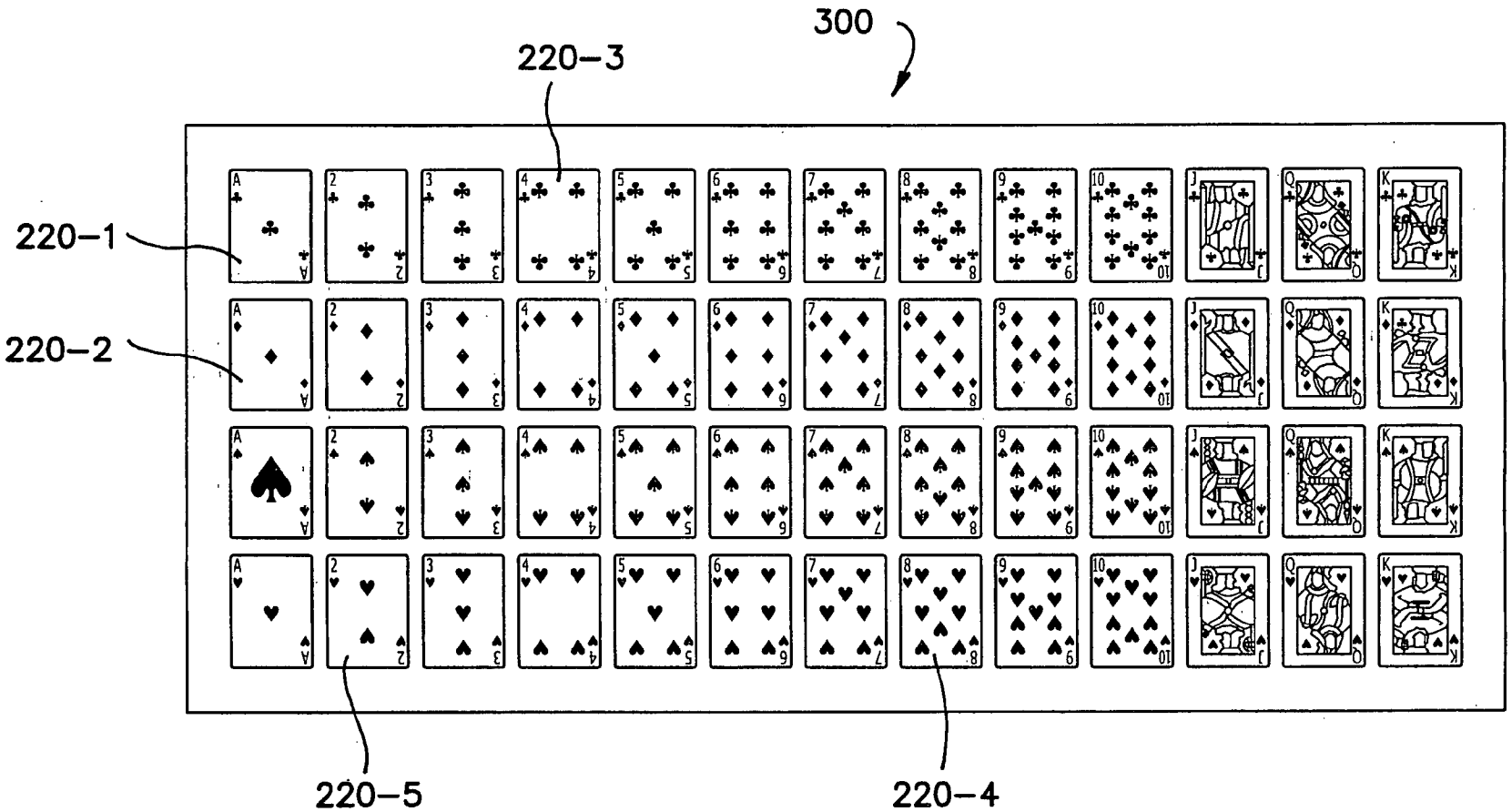
FIG. 3 shows a gaming device display screen highlighting five player selected cards.
Figure 4:
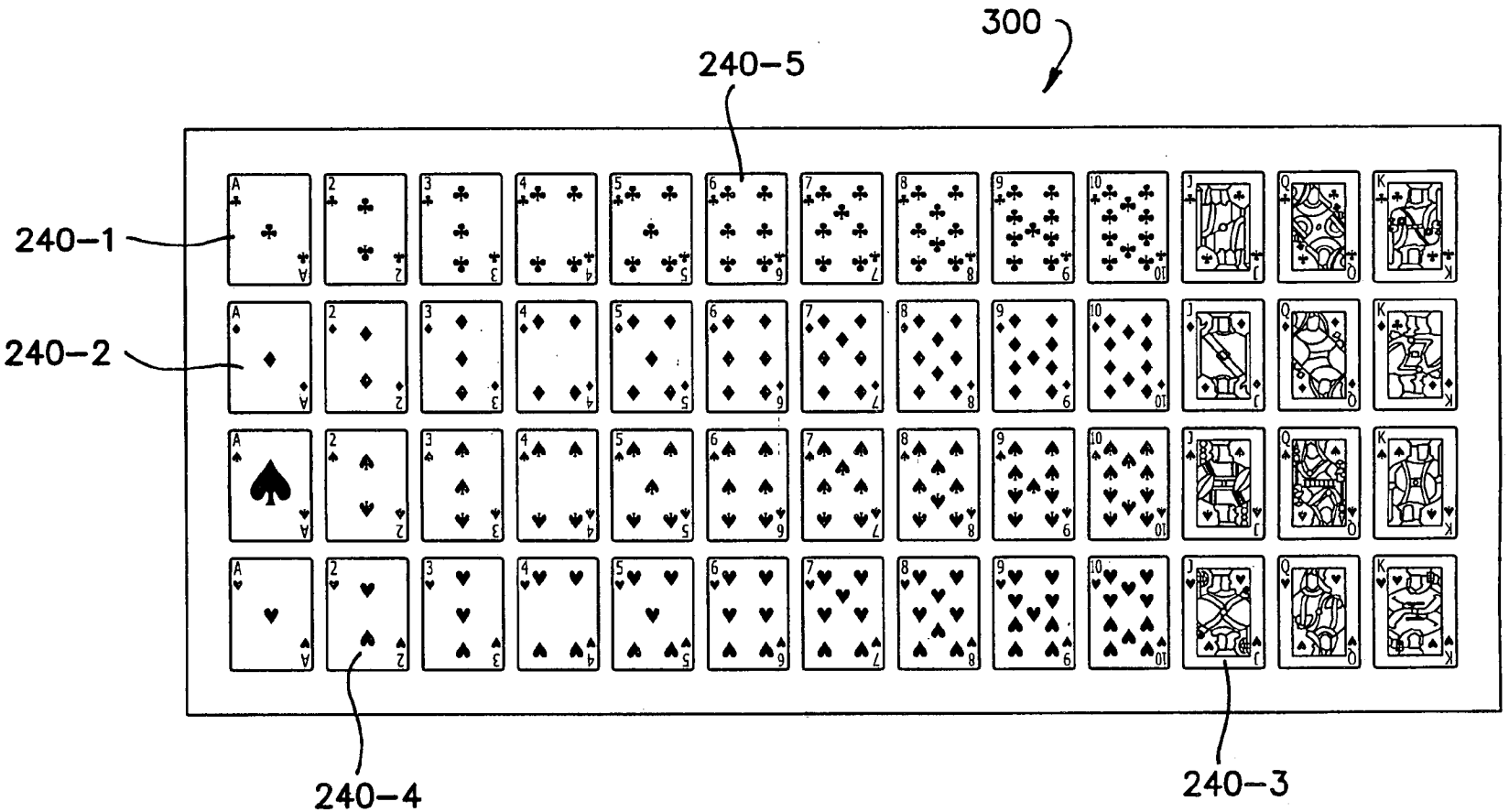
FIG. 4 shows a gaming device display screen once five random cards have been selected.

After causing a wager to be placed, a player is able to select one or more of the displayed cards. As shown in FIG. 3, the player has selected five cards comprising the A♣ 220-1, A♦ 220-2, 4♣ 220-3, 8♥ 220-4 and 2♥ 220-5. The selection is made using the directional buttons 160-1 through 160-4 or by touching the cards 220-1 through 220-5 on the display screen 300 wherein the screen 300 incorporates touchscreen technology. Once selected, the cards 220-1 through 220-5 or their borders are highlighted by changing color, illumination and/or brightness. Also, selected cards may blink or otherwise be highlighted to denote their selection. Once the cards 220-1 through 220-5 are selected, the player depresses the start button 200 or its touchscreen equivalent to cause the gaming machine 100 to select a pre-determined number of random cards from the displayed cards. In this example, and as shown in FIG. 4, five cards comprising the A♣ 240-1, A♦ 240-2, J♥ 240-3, 2♥ 240-4 and 6♣ 240-5 have been randomly selected by the machine. As shown, the three randomly selected cards comprising the A♣ 240-1, A♦ 240-2 and 2♥ 240-4 match three of the player selected cards, namely the A♣ 220-1, A♦ 220-2 and 2♥ 220-5. Also, the five randomly selected cards 240-1 through 240-5 comprise a pair of Aces.

In the first embodiment of the present invention, the player receives awards based on both the number of player selected cards 220-1 through 220-5 which match the randomly selected cards 240-1 through 240-5 and the strength of the poker hand formed by the randomly selected cards 240-1 through 240-5. In this example the player has matched three of the five selected player cards and has received a pair of Aces formed by the randomly selected cards. Like keno, the more player selected cards which match the randomly selected cards, the greater the payout. Also, like video poker, a pre-established pay table based on winning five card poker hands provides a list of payouts corresponding to final poker hands. The pay table may be modified to account for the random selection of more or less than five cards. For example, randomly selecting less than five cards requires the creation of two, three and four-card poker hands and corresponding alternative payouts. Similarly, randomly selecting more than five cards results in increased chances of achieving winning five-card poker hands (or seven-card poker hands). The random selection of a single card may be paid according to the rank of the single card. Consequently, an Ace is the most valuable card selection followed by a King and so on.

In an alternative embodiment, after the first random selection of cards, the player is provided with the opportunity to discard one or more of the randomly selected cards in favor of randomly selected replacement cards. Depending on the game, player decisions regarding holding and discarding are based on matching more cards and/or increasing the strength of the resultant poker hand. With the draw feature, corresponding payouts are likely reduced based on the increased chances of achieving pre-established winning results.

In alternative embodiments, players receive payouts solely for matching player selected cards with randomly selected cards or the strength of one or more poker hands formed by the randomly selected cards. These embodiments may also incorporate the draw feature.

In another embodiment, players place side wagers related to specific poker hands being formed by the randomly selected cards. In this manner, players may wager that a specific hand (e.g., four Aces) or general hand (e.g., four of a kind) is going to be formed with the randomly selected cards. The payouts for wagers on the specific hands are larger than for corresponding general hands. The side wagers may also be based on the resultant poker hand subsequent to a draw.

Figure 5:
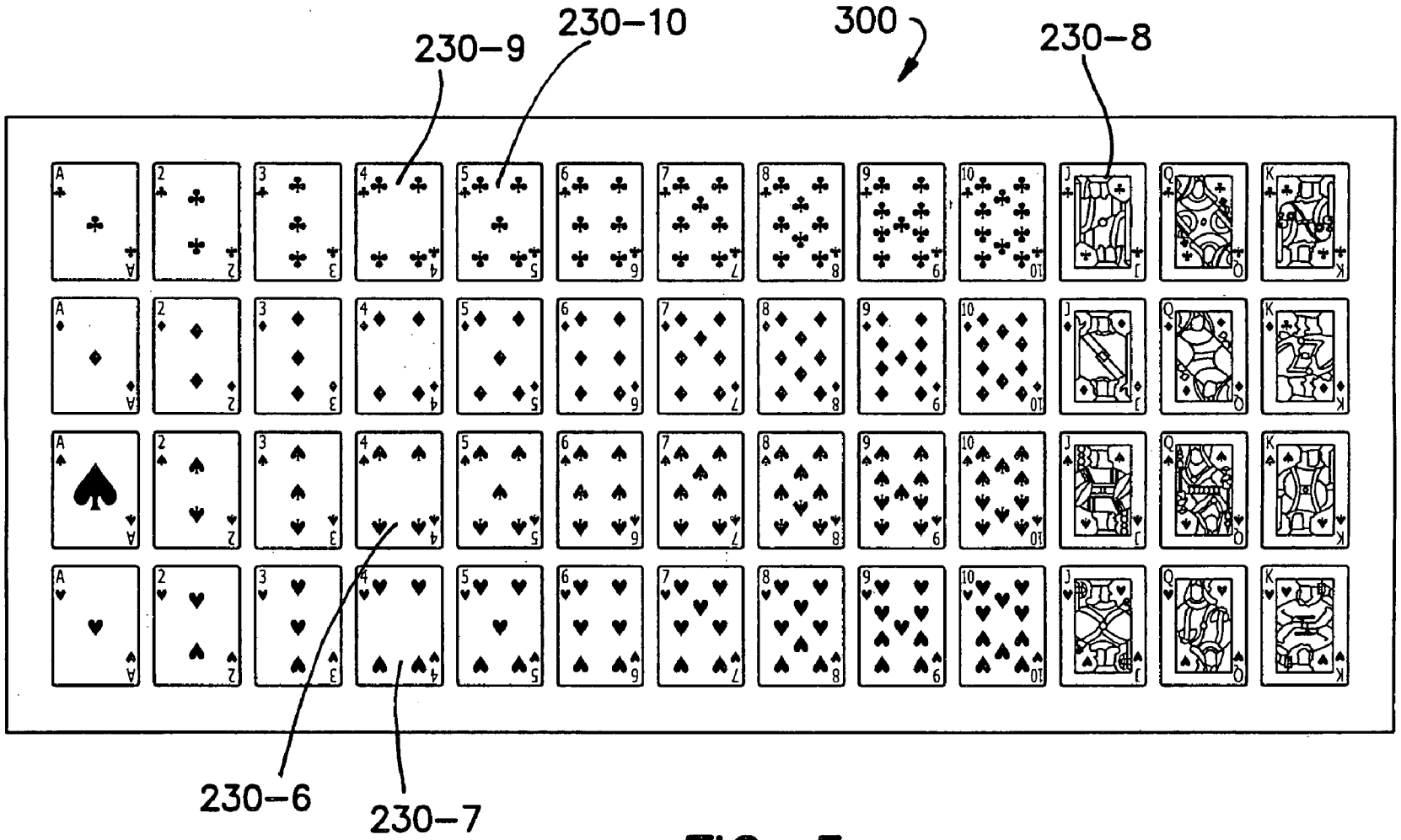
FIG. 5 shows a gaming device display screen depicting a bonus award outcome.

A bonus feature applicable to any embodiment of the present invention comprises a payout for positions of, or patterns formed by, the randomly selected cards. Referring to FIG. 5 for example, the random selection of the cards comprising the 4♠ 230-6, 4♥ 230-7, J♣ 230-8, 4♣ 230-9 and 5♣ 230-10 results in one or more bonus outcomes. That is, cards 230-6 and 230-7 and cards 230-9 and 230-10 are arranged adjacent to one another, respectively. Accordingly, a player is entitled to a pre-established bonus award. Bonus awards may also be based on card patterns such as four corners, columns, etc. An alternative bonus scheme involves a secondary or bonus game triggered by one or more primary game outcomes. For example, a bonus game may be triggered in response to a player selecting a joker and the joker also being randomly selected by the machine. The bonus game may comprise any mechanism, including spinning wheels, video outputs or mechanical devices, for providing the player with a bonus award or a chance at a bonus award.

Figure 6:
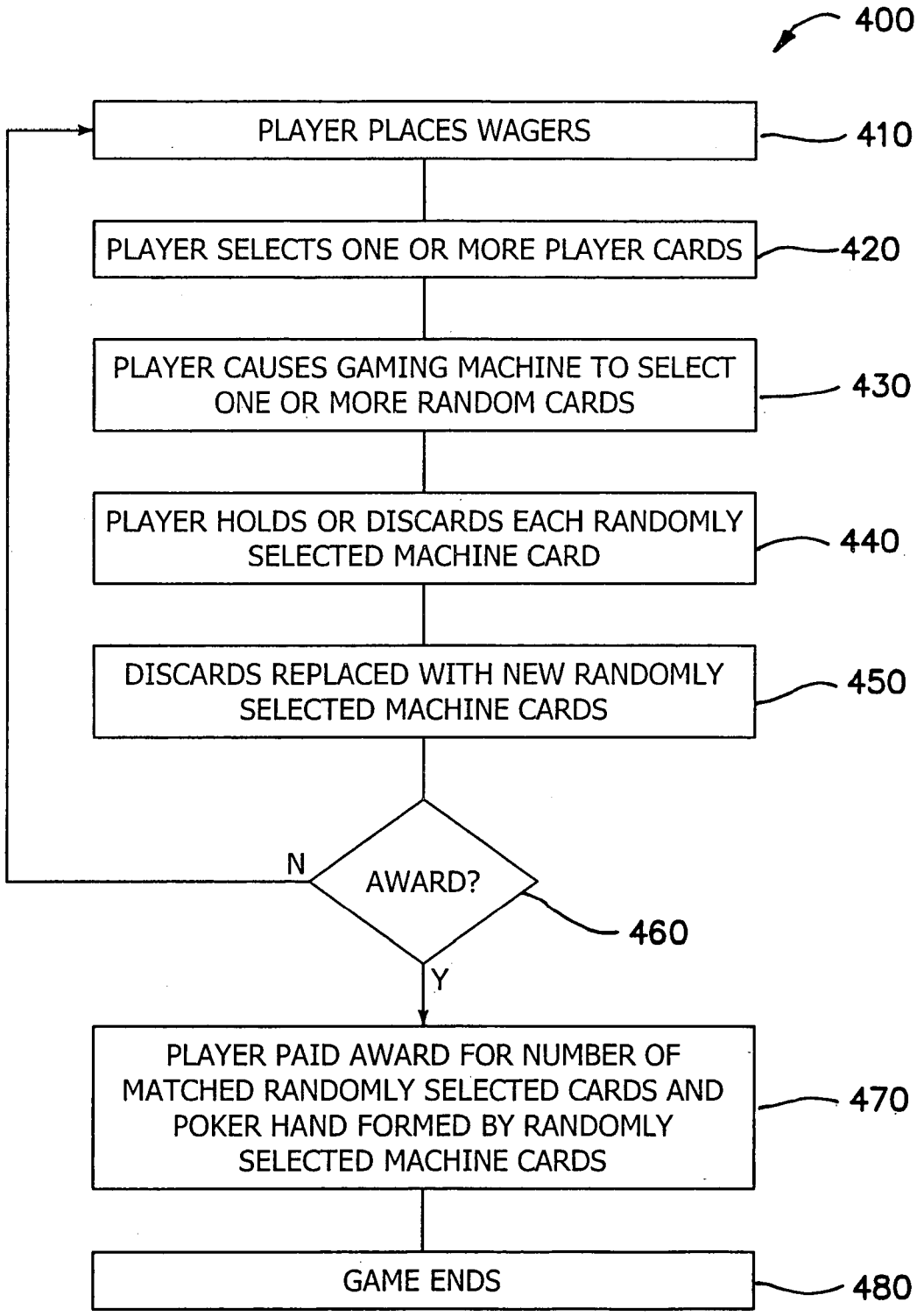
FIG. 6 shows a flow chart detailing play of one embodiment of the present invention.

Now referring to FIG. 6, a flow chart 400 details play of one embodiment of the present invention facilitated by an electronic gaming machine. At step 410, a player causes a game wager and any side wagers to be placed. The wagers may be taken from a machine credit or may be inserted by the player. Then, at step 420, the player selects one or more player cards. Once the player cards have been selected, at step 430, the player causes the machine to randomly generate and identify one or more cards. In a non-draw embodiment, the player is paid based on the number of matches between the player selected cards and the randomly selected cards and/or the strength of the poker hand of the five randomly selected cards. However, with the draw option, at step 440, the player holds or discards each of five randomly selected cards. At step 450, any discards are replaced with new randomly selected cards. Next, at step 460, the machine determines whether the player is entitled to an award for the game wager or any side wagers. If so, the player is paid at step 470. Optionally, at step 470, the player may receive a bonus award for randomly selected cards being arranged in a pre-established winning fashion. At step 480 the game ends.

The embodiments of the present invention may also be practiced in a live gaming environment. In one such embodiment, players select cards via a paper ticket. The ticket is then provided to casino personnel or fed into a keno kiosk. In return, the player receives a record of the payer selected cards. At a certain time, random card ranks are selected. The random selection may be facilitated by a container of air-agitated balls having a card ranked depicted thereon. The container is in contact with a tube which randomly draws in the pre-established number of balls and corresponding card ranks. A random number generator may also select the cards. Players receive awards based on a number of matches between player selected cards and the randomly selected cards and the strength of a poker hand formed by the one or more randomly selected cards. Any number of players may participate in such an embodiment.

Alternatively, a table game facilitates a more restricted play of the game. In this embodiment, a gaming table layout (not shown) incorporates a plurality of player card selection grids and a plurality of player markers for players to temporarily mark their player cards on the grid. Once each player has placed a wager and marked or selected his or her cards on his or her grid, a dealer deals face-up one or more cards from a deck of playing cards. A random number generator in communication with a display device may also act to randomly select cards. The dealer then resolves player wagers based on the number of matches between player selected cards and the dealt cards and/or the strength of the poker hand formed by the one or more randomly selected cards.

Figure 7:
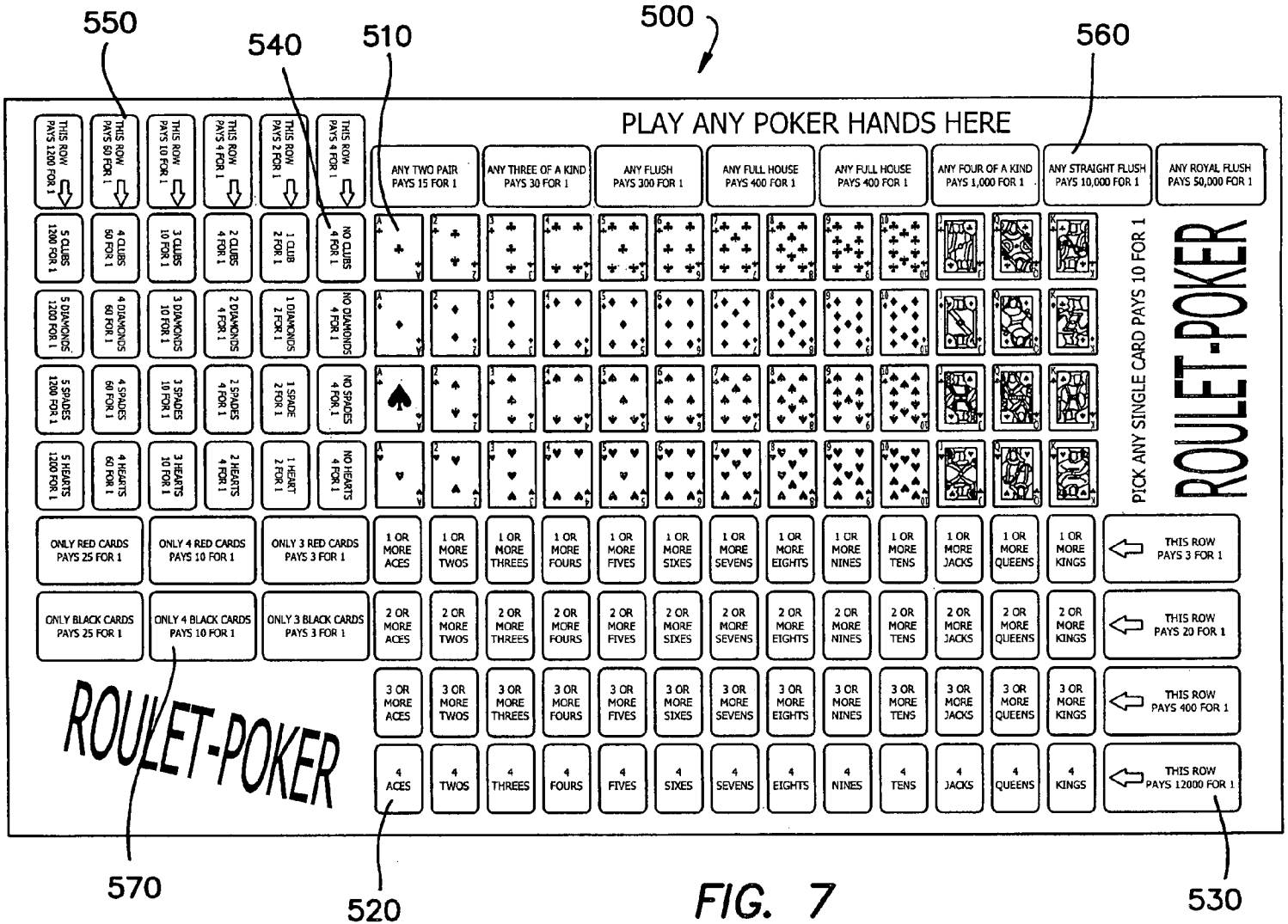
FIG. 7 shows a table layout for a multi-player live game embodiment of the present invention.

FIG. 7 shows a multi-player embodiment facilitated by a table layout 500 providing means for a plurality of player to place wagers. In a manner similar to live roulette, multiple players place wagers on the single table layout 500. Once all wagers are placed, a dealer deals five cards and resolves all wagers. The layout 500 comprises a series of wagers based on single cards, multiple card combinations and/or card colors. Single card wagers are depicted as replicas of playing cards 510. Below each aligned card rank there are wagers 520 dependent on the exact number of specific card ranks. Players may also wager on entire rows of exactly one, two, three or four specific card ranks 530 appearing in the five dealt cards. Next to the rows of cards 510 players may place wagers on zero, one, two, three or four specific suits 540. Next to the suit wagers 540, players may place wagers on the entire row of identified suit wagers 550 appearing in the five dealt cards. Above the playing cards 510 there are poker hand wagers 560 which include wagers on poker hands comprising any two pair up to, and including, a royal flush. Wagers 570 allow players to wager on different color card outcomes. For player convenience, the layout 500 also depicts illustrative payouts corresponding to the numerous wagers. It is also conceivable to include jokers in the standard deck. The jokers may act as wild cards and tend to create more game versatility.

Although the invention has been described in detail with reference to several embodiments, additional variations and modifications exist within the scope and spirit of the invention as described and defined in the following claims.

We claim:

1. A method of conducting a wagering game comprising:
accepting a player wages;
causing a player to select multiple cards from a plurality of face-up cards;
causing one or more cards from the plurality of cards to be randomly selected;
comparing the randomly selected cards to the player selected cards and evaluating a poker hand formed by the randomly selected cards; and
resolving a player wager based on a number of randomly selected cards matching the player selected cards and the evaluation of the poker hand formed by the randomly selected cards.

2. The method of claim 1 wherein the plurality of cards comprises a standard deck of fifty-two playing cards.

3. The method of claim 1 further comprising allowing the player to hold or discard each of the randomly selected cards and randomly selecting a new card for each discard.

4. The method of claim 1 facilitated by an electronic gaming device.

5. The method of claim 4 wherein the plurality of cards is displayed face-up on a gaming device display screen.

6. The method of claim 1 further comprising allowing players to place side wagers on which poker hand will be formed by the randomly selected cards.

7. The method of claim 1 facilitated by a gaming table layout.

8. A method of conducting a wagering game comprising:
displaying a plurality of cards;
providing means for a player to select multiple cards from the plurality of cards wherein said player selects multiple cards from the plurality of cards;
randomly identifying one or more of the plurality of cards;
comparing the randomly identified cards to player selected cards and evaluating a poker hand formed by the randomly identified cards; and
resolving a player wager based on a number of randomly identified cards matching the player selected cards and a strength of the evaluated poker hand formed by the randomly identified cards.

9. The method of claim 8 wherein the plurality of cards comprises a standard deck of fifty-two playing card.

10. The method of claim 8 further comprising allowing the player to hold or discard each of the randomly identified cards and randomly identifying a new card for each discard.

11. The method of claim 8 facilitated by an electronic gaming device.

12. The method of claim 8 wherein a player receives an award for randomly identified cards which are adjacent to one another.

13. The method of claim 8 further comprising allowing players to place side wagers on which poker hand will be formed by the randomly selected cards.

14. A method of conducting a wagering game comprising;
allowing a player to select five cards from a deck of fifty two cards;
randomly identifying five cards from the deck of fifty two cards;
the player holding or discarding each of the randomly identified five cards;
randomly identifying new cards for each discard;
comparing a final five randomly identified cards to the five player selected cards and evaluating a poker hand formed by the final five randomly identified cards; and
resolving a player wager based on a number of the final five randomly identified cards matching the five player selected cards and a strength of the poker hand formed by the five final randomly identified cards.

15. The method of claim 14 wherein the method is facilitated by an electronic gaming device.

16. The method of claim 14 wherein the fifty two cards are presented face-up on a gaming device display screen.

17. The method of claim 14 further comprising a bonus award corresponding to randomly identified cards being adjacent to one another.

18. The method of claim 14 further comprising allowing players to place side wagers on which poker hands will be formed by the randomly selected cards.

* * * * *